US008888312B2

(12) United States Patent
Ono

(10) Patent No.: US 8,888,312 B2
(45) Date of Patent: Nov. 18, 2014

(54) POWER GENERATING LAMP AND ILLUMINATION APPLIANCE

(75) Inventor: Yoshiko Ono, Himeji (JP)

(73) Assignee: Nihon Energy Institute Co., Ltd., Hyogo (JP)

( * ) Notice: Subject to any disclaimer, the term of this patent is extended or adjusted under 35 U.S.C. 154(b) by 35 days.

(21) Appl. No.: 13/807,923

(22) PCT Filed: Apr. 15, 2011

(86) PCT No.: PCT/JP2011/059364

§ 371 (c)(1), (2), (4) Date: Dec. 31, 2012

(87) PCT Pub. No.: WO2012/008194

PCT Pub. Date: Jan. 19, 2012

(65) Prior Publication Data

US 2013/0107510 A1 May 2, 2013

(30) Foreign Application Priority Data

Jul. 15, 2010 (JP) ..... 2010-160470

(51) Int. Cl.

| | |
|---|---|
| ***F21L 14/00*** | (2006.01) |
| ***F21S 9/03*** | (2006.01) |
| ***H05B 33/08*** | (2006.01) |
| ***H05B 41/42*** | (2006.01) |
| ***H05B 35/00*** | (2006.01) |
| *F21Y 103/02* | (2006.01) |
| *F21Y 103/00* | (2006.01) |

(52) U.S. Cl.

CPC ..... *F21L 14/00* (2013.01); *F21Y 2103/022* (2013.01); *F21S 9/03* (2013.01); *H05B 33/0809* (2013.01); *H05B 41/42* (2013.01); *F21Y 2103/00* (2013.01); *H05B 35/00* (2013.01)

USPC ..... 362/190; 362/157; 362/183

(58) Field of Classification Search

CPC ..... F21L 14/00; F21S 9/03; H05B 33/0809; H05B 35/00

USPC ..... 362/157, 183, 190

See application file for complete search history.

(56) References Cited

U.S. PATENT DOCUMENTS

| | | | | |
|---|---|---|---|---|
| 7,360,919 | B2 * | 4/2008 | Chan | 362/183 |
| 7,731,383 | B2 * | 6/2010 | Myer | 362/145 |
| 8,157,406 | B2 * | 4/2012 | Zheng | 362/183 |

FOREIGN PATENT DOCUMENTS

| | | | |
|---|---|---|---|
| JP | 10-241424 | A | 9/1998 |
| JP | 2005-322608 | A | 11/2005 |
| JP | 2007-257928 | A | 10/2007 |
| JP | 3146894 | U | 12/2008 |
| JP | 2009-76427 | A | 4/2009 |
| JP | 3154484 | U | 10/2009 |
| JP | 2010-027212 | A | 2/2010 |
| JP | 2010-135206 | A | 6/2010 |

OTHER PUBLICATIONS

International Search Report, directed to PCT/JP2011/059364, mailed on Jun. 14, 2011, 4 pages including English translation.

* cited by examiner

*Primary Examiner* — Stephen F Husar
*Assistant Examiner* — James Cranson, Jr.
(74) *Attorney, Agent, or Firm* — Smith Patent Office

(57) ABSTRACT

A power generating lamp capable of effectively use electrical energy of lighting to generate high electromotive force comprising a linear or annular lamp tube that is supplied with power and emits light and one or a plurality of solar panels that have an arc shape in a cross-sectional view or a linear shape a cross-sectional view.

15 Claims, 11 Drawing Sheets

| INPUTS | | | | OUTPUT | | |
|---|---|---|---|---|---|---|
| CLOCK↑ | DATA1 | RESET1 | SET1 | Q | $\bar{Q}$ | |
| ↗ | 0 | 0 | 0 | 0 | 1 | |
| ↗ | 1 | 0 | 0 | 1 | 0 | |
| ↘ | X | 0 | 0 | Q | $\bar{Q}$ | No Change |
| X | X | 1 | 0 | 0 | 1 | |
| X | X | 0 | 1 | 1 | 0 | |
| X | X | 1 | 1 | 1 | 1 | |

X = Dont' Care
↑ = Level Change

POWER GENERATING LAMP AND ILLUMINATION APPLIANCE

TECHNICAL FIELD

The present Invention relates to a power generating lamp and an illumination appliance, and more particularly, to a lamp and an appliance capable of effectively using the electrical energy of lighting.

BACKGROUND ART

A technique has been proposed in which a solar panel is attached to a reflector which is provided on the rear side of a fluorescent lamp and receives light emitted from the fluorescent lamp, a capacitor or a rechargeable battery is charged by the electromotive force of the solar panel, and a voltage is applied from the capacitor or the rechargeable battery to an emergency light or a guidance light to turn on the emergency light or the guidance light when a switch of a fluorescent lamp appliance is turned off or when the fluorescent lamp appliance is turned off, thereby effectively using electrical energy (PTL 1 and PTL 2).

In addition, in recent years, with the rapid progress of electronic technology, LEDs with low power consumption and high brightness have been put to practical use, and an LED lamp has been used instead of the fluorescent lamp (PTL 3 and PTL 4).

CITATION LIST

Patent Literature

PTL 1: JP-A-2010-135206
PTL 2: Japanese Utility Model Registration No. 3146894
PTL 3: JP-A-2007-257928
PTL 4: JP-A-2010-27212

SUMMARY OF INVENTION

Technical Problem

However, in the power generating apparatuses disclosed in PTL 1 and PTL 2, the distance between the fluorescent lamp and the solar panel is equal to or greater than 15 mm. Therefore, even when a high-intensity fluorescent lamp is used and a solar panel with a large area is used, little practical electromotive force is obtained.

The present Invention has been made in view of the above-mentioned structure problems and an object of the present Invention is to provide a power generating lamp capable of effectively using the electrical energy of lighting to generate sufficient electromotive force.

Solution to Problem

According to the present Invention, there is provided a power generating lamp including:

a linear or annular lamp tube that is supplied with electric power and emits light;

one or a plurality of solar panels that have an arc shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth (⅕) of the length of the outer circumference of a cross-section of the lamp tube and equal to or less than half the length of the outer circumference, receive light emitted from a rear surface of the lamp tube, and generate electromotive force;

a transparent heat-resistant layer that is formed on a light receiving surface of the solar panel and is attached to the rear surface of the lamp tube or is arranged on the rear side of the lamp tube such that a distance between the light receiving surface thereof and the rear surface of the lamp tube is equal to or less than 10 mm; and an electric wire that extracts the electromotive force of the solar panel.

One of the characteristics of the present Invention is that the solar panel is attached to the rear surface of the lamp tube of the illuminating lamp or is 10 mm or less away from the rear surface of the lamp tube.

The magnitude of the electromotive force of the solar panel is inversely proportional to the square of the distance between the solar panel and a light source. In the present Invention, the distance between the light receiving surface of the solar panel and the lamp tube is equal to or less than 10 mm, which is shorter than that in PTL 1 and PTL 2. Therefore, the solar panel can generate high electromotive force.

When the solar panel comes close to or contacts with the lamp tube, there is a concern that the temperature of the solar panel will be increased by heat generated from the lamp tube, the performance of the solar panel will be reduced, and power generation efficiency will be reduced. However, in the case of a fluorescent lamp, the Inventors' experiments proved that the portion (high-temperature region) where the filament was provided had a high temperature of about 65° C. to 75° C., a region between the high temperature regions had a relatively low temperature of 38° C. to 40° C., and the performance of the solar panel was hardly reduced at these low temperatures.

In the present Invention, since the transparent heat-resistant layer, for example, a transparent heat-resistant glass or transparent heat-resistant plastic, is formed on the light receiving surface of the solar panel, it is possible to significantly reduce the influence of heat generated from the fluorescent lamp on the power generation performance of the solar panel. As a result, it is possible to guarantee, for example, the power generation efficiency or durability of the power generating lamp.

Illuminating lamps using LEDs have been put to practical use and LED lamps tend to be used instead of fluorescent lamps. Commerically available LED lamps include LEDs facing downward in order to emit light downward. However, in recent years, an LED lamp has been proposed which includes LEDs facing upward such that a large dark shadow does not occur on the rear side of the LED lamp. A solar panel may be provided on the rear side of a lamp tube of this type of LED lamp to form the power generating lamp according to the Invention.

When the solar panel is provided on the rear side of the lamp tube, the solar panel needs to receive a sufficient amount of illumination light, and it is necessary to prevent a reduction in the brightness of illumination light which is emitted downward due to the solar panel. Therefore, the solar panel has a width that is equal to or greater than one-fifth (⅕) of the length of the outer circumference of the cross-section of an illuminating lamp, such as a fluorescent lamp or an LED lamp, and equal to or less than half the length of the outer circumference. For example, since the length of the outer circumference of the cross-section of a commercially available fluorescent lamp is about 9.0 cm, the width of the solar panel may be equal to or greater than 2.0 cm and equal to or less than 4.5 cm. However, when there is a concern that a dark shadow will be formed on the rear side of the illuminating light and the region of the dark shadow will be expanded to cause a sense of incongruity, it is preferable that the width of the solar panel be one-third (⅓) of the length of the outer circumference of the cross-section of the lamp tube. For example, when the length of the outer circumference of the cross-section of the fluorescent lamp is about 9.0 cm, it is preferable that the width of the solar panel be about 3.0 cm.

In the present Invention, the term "lamp tube" includes lamp tubes of both fluorescent lamps and LED lamps. In addition, the lamp tube may have a linear shape or an annular shape.

In the above-mentioned aspect, the solar panel has an arc shape in a cross-sectional view. However, for example, in terms of the manufacture of the solar panel, the solar panel may have a linear shape in a cross-sectional view as long as the condition that the light receiving surface of the solar panel is arranged so as to be 10 mm or less away from the rear surface of the lamp tube can be satisfied.

According to another aspect of the present Invention, there is provided a power generating lamp including:

a linear or annular lamp tube that is supplied with electric power and emits light;

one or plural of solar panel that have a linear shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth of the length of the outer circumference of a cross-section of the lamp tube and equal to or less than half the length of the outer circumference, receive light emitted from a rear surface of the lamp tube, and generate electromotive force;

a transparent heat-resistant layer that is formed on a light receiving surface of the solar panel and is arranged on the rear side of the lamp tube such that a distance between the light receiving surface and the rear surface of the lamp tube is equal to or less than 10 mm; and an electric wire that extracts the electromotive force of the solar panel.

The solar panel may have a length that is equal to the total length of the lamp tube in the longitudinal direction or the total length thereof in the circumferential direction, and the transparent heat-resistant layer may be attached to the lamp tube over the entire length thereof. However, in order to reduce the deterioration of the performance of the solar panel, the solar panel may have a length that is equal to the total length of the low-temperature region of the lamp tube in the longitudinal direction or the total length thereof in the circumferential direction, and a laminate of the solar panel and the transparent heat-resistant layer may be attached to the rear surface of the low-temperature region.

When it is necessary to improve the heat dissipation performance of the solar panel, heat-dissipating metal foil, for example, aluminum foil may be attached to the rear surface of the solar panel. In this case, it is possible to improve the heat dissipation characteristics of the solar panel.

When the light receiving surface of the solar panel is arranged so as to be 10 mm or less away from the rear surface of the lamp tube, a holder frame may be provided to hold the solar panel and the transparent heat-resistant layer on the rear side of the lamp tube.

The shape of the holder frame is not particularly limited as long as the holder frame can hold the laminate of the solar panel and the transparent heat-resistant layer. For example, as described in the following embodiment, the holder frame may have a box shape with the top and bottom open. The material forming the holder frame is not particularly limited. For example, the holder frame may be made of an aluminum material with high thermal conductivity.

The electromotive force of the power generating lamp may be applied to the emission of light from LEDs and may be used for guidance lights or emergency lights, and supplemental lighting or main lighting.

According to still another aspect of the present Invention, there is provided a illumination appliance including:

a power generating lamp including a linear or annular lamp tube that is supplied with power and emits light, one or a plurality of solar panels that have an arc or linear shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth of the length of the outer circumference of a cross-section of the lamp tube and equal to or less than half the length of the outer circumference, receive light emitted from a rear surface of the lamp tube, and generate electromotive force, a transparent heat-resistant layer that is formed on a light receiving surface of the solar panel and is attached to the rear surface of the lamp tube or is arranged on the rear side of the lamp tube such that a distance between the light receiving surface and the rear surface of the lamp tube is equal to or less than 10 mm, and an electric wire that extracts the electromotive force of the solar panel; and a LED circuit that includes a plurality of LEDs, receives the electromotive force of the power generating lamp, and emits light.

When the lighting apparatus is attached to a fluorescent lamp dummy tube in which caps provided at both ends are connected to each other by a conductor, which is a predetermined resistive component, the fluorescent lamp dummy tube which is turned off can be used for illumination.

The electromotive force of the solar panel may be directly given to the LED circuit. However, the electromotive force may be charged to a rechargeable battery or a capacitor once. That is, the illumination appliance may include a charging circuit that is connected to the electric wire, charges the electromotive force of the solar panel to the capacitor or the rechargeable battery, and supplies power to the LED circuit.

When a white LED, a red LED, and a green LED are used as the LEDs of the LED circuit and the color temperature is changed by the addition of colors, it is possible to change the atmosphere of the same room to a cool color with a correlated color temperature of 6700K (fresh atmosphere), a natural color with a correlated color temperature of 5000K (natural atmosphere), and a warm color with a correlated color temperature of 3000K (calm atmosphere) and improve the comfort of the living space.

When the LED circuit is configured such that the color temperature thereof is changed, the color temperature can be changed as follows. When the user wakes up, the color temperature of illumination light is slowly changed like the morning light to lead the user to a wakeful state and bright light is emitted to wake up the user. At night, light with a low color temperature is emitted to calm the user down.

That is, the LED circuit may include: a pair of white LED circuits each of which includes blue, red, and green LEDs connected in series to each other and which are connected in parallel to each other in the opposite direction and emit white light; a first color calibration LED circuit that is connected in parallel to the white LED circuits and emits green light; and a second color calibration LED circuit that is connected in parallel to the white LED circuits and the first color calibration LED circuit, is connected to the first color calibration LED circuit in the opposite direction, and emits red light. The lighting apparatus may further include a driver circuit that applies a voltage with an adjusted duty ratio to both ends of the white LED circuit while inverting the polarity of the voltage. The duty ratio may be controlled to adjust the color temperature.

The LED circuit may include: a white LED circuit that emits white light; a first color calibration LED circuit that can adjust an on current, is connected in parallel to the white LED circuit, and emits green light; and a second color calibration LED circuit that can adjust an on current, is connected in parallel to the white LED circuit and the first color calibration LED circuit, and emits red light. The on currents of the first color calibration LED circuit and the second color calibration LED circuit may be controlled to adjust the color temperature.

According to the Invention, in a two-lamp-series-type illuminating lamp equipment in which both ends of one of two illuminating lamps are connected to each other by a current applying circuit, which is a predetermined resistive component, and the current applying circuit is turned off by a flip-flop operation of a control circuit to turn off the one illuminating lamp when a power switch is changed from an on state to an off state and is turned on again within a predetermined period of time, a solar panel is provided on a rear surface of an illuminating lamp to be turned on to form a power generating lamp, and an LED circuit is provided in the vicinity of the illuminating lamp which is turned off.

DESCRIPTION OF EMBODIMENTS

Figure 1:
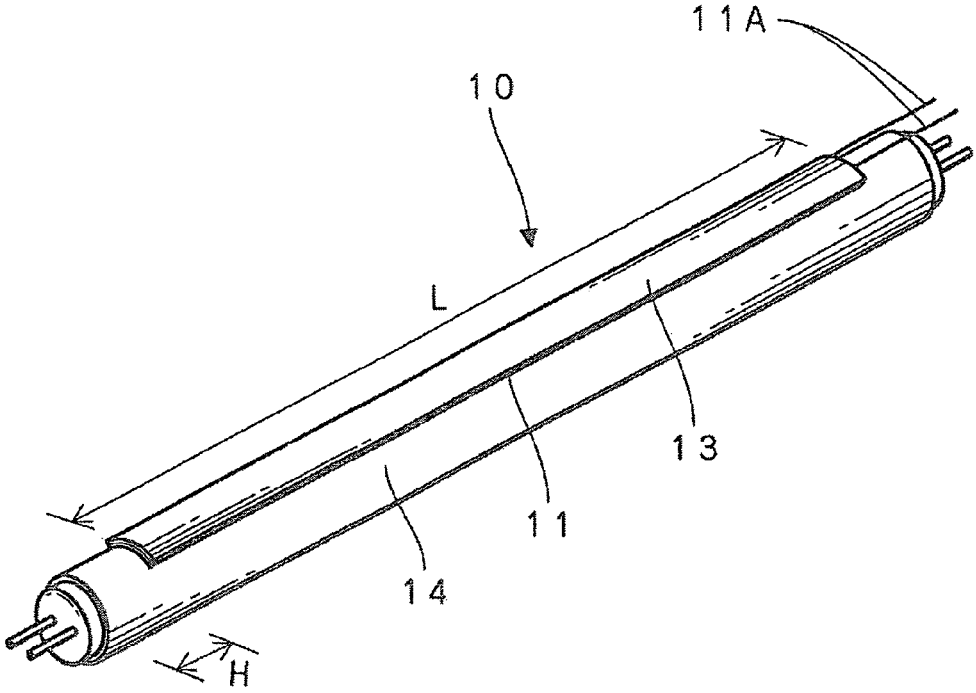
FIG. 1 is a schematic perspective view illustrating an exemplary embodiment of a power generating lamp according to the invention.
Figure 2:
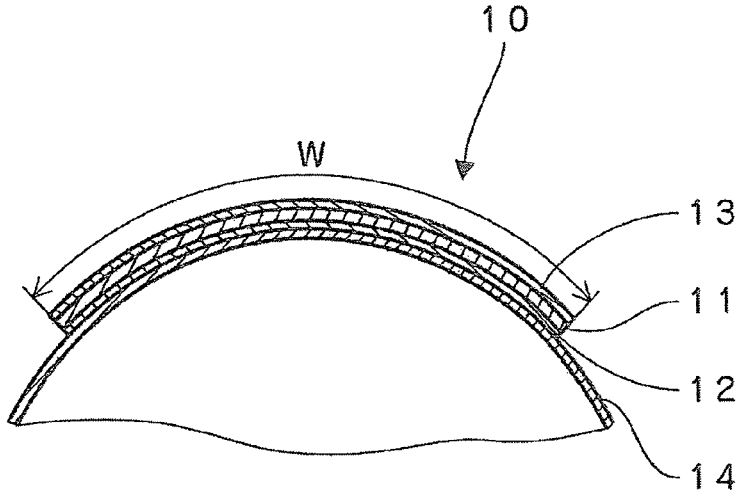
FIG. 2 is a front view illustrating the cross-sectional structure of the embodiment.

Hereinafter, exemplary embodiments of the present Invention will be described in detail with reference to the accompanying drawings. FIGS. 1 and 2 show an exemplary embodiment of a power generating lamp according to the present Invention. In FIGS. 1 and 2, a power generating lamp 10 is a linear fluorescent lamp and a solar panel 11 with a length of 900 mm and a width W of 30 mm (which is about one-third of the length of the outer circumference of the cross-section of a lamp tube 14) is provided on the rear surface of the lamp tube 14 of the fluorescent lamp.

The solar panel 11 has an arc shape in a cross-sectional view and a transparent heat-resistant glass 12 is formed on a light receiving surface of the solar panel 11. Aluminum foil 13 for heat dissipation is attached to the rear surface of the solar panel 11 and the electromotive force of the solar panel 11 is drawn through electric wires 11A.

Portions H of the fluorescent lamp which are about 10 mm away from both ends of the lamp tube 14 are high-temperature regions which reach a temperature of about 68° C. to 72° C. due to heat generated from a filament when the fluorescent lamp is turned on. A low-temperature region L with a temperature of 38° C. to 39° C. is provided between the high-temperature regions H. A laminate of the aluminum foil 13, the solar panel 11, and the heat-resistant glass 12 is attached to the low-temperature region L of the lamp tube 14 of the fluorescent lamp by, for example, an adhesive or bond.

Figure 3:
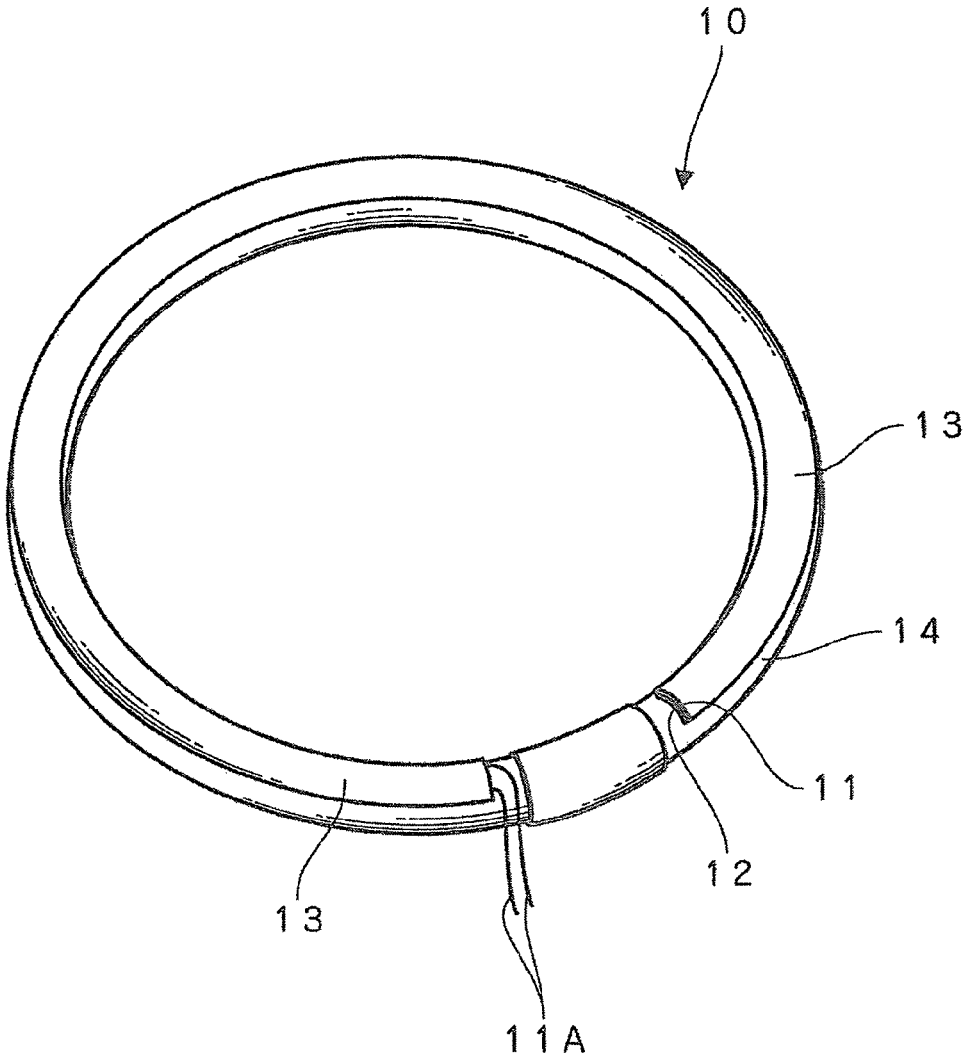
FIG. 3 is a schematic perspective view illustrating a second embodiment.

FIG. 3 shows a second embodiment of the power generating lamp according to the Invention. In FIG. 3, the same reference numerals as those in FIGS. 1 and 2 denote the same or equivalent components. In this embodiment, an annular lamp tube 14 is used in a fluorescent lamp and a laminate of a transparent heat-resistant glass 12, a solar panel 11, and aluminum foil 13 for heat dissipation is attached to the rear surface of the low-temperature region of the lamp tube 14 by, for example, a transparent adhesive.

Figure 4:
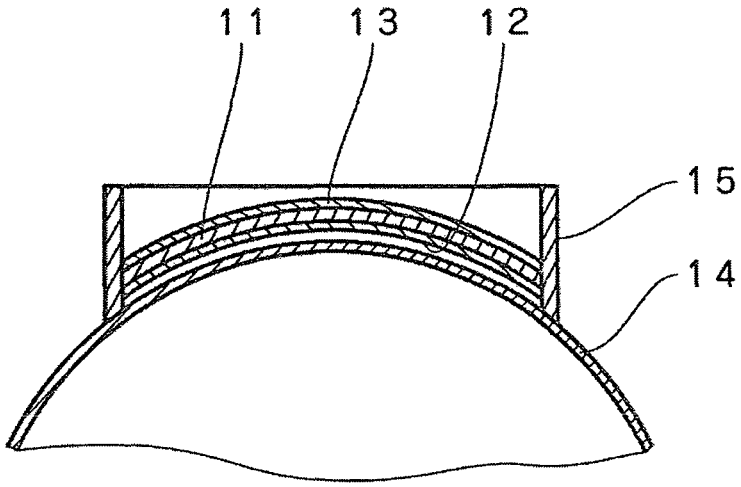
FIG. 4 is a front view illustrating the cross-sectional structure of a third embodiment.

FIG. 4 shows a third embodiment of the power generating lamp according to the Invention. In FIG. 4, the same reference numerals as those in FIGS. 1 and 2 denote the same or equivalent components. In this embodiment, a laminate of a transparent heat-resistant glass 12, a solar panel 11, and aluminum foil 13 is provided and held in a holder frame 15. The holder frame 15 is made of, for example, a heat-resistant plastic material and is manufactured in a rectangular frame shape with the top and bottom open. The holder frame 15 is attached to the rear surface of the lamp tube 14 by, for example, an adhesive such that the light receiving surface of the solar panel 11 is 10 mm or less away from the rear surface of the lamp tube 14.

Figure 5:
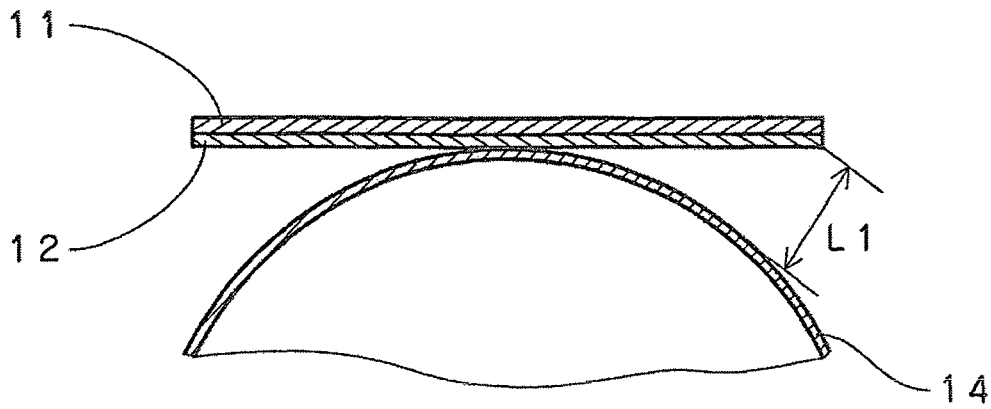
FIG. 5 is a diagram schematically illustrating a method of measuring the electromotive force of the power generating lamp.

The power generation capability of the power generating lamp according to the Invention was measured and compared with that of photovoltaic power generation. A solar panel 11 shown in FIG. 5 was used to measure the power generation capability. The solar panel 11 is a flat panel with a width of 30 mm and a length of 950 mm and has a linear shape in a cross-sectional view. A transparent heat-resistant glass 12 is attached to the light receiving surface of the solar panel 11. In addition, one lamp of two type lamps with an electronic ballast Hf32W was used and set such that the center of the transparent heat-resistant glass 12 come into contact with the rear surface of the lamp and a distance L1 from the rear surface of the lamp tube 14 to both ends of the transparent heat-resistant glass 12 was equal to or less than 10 mm.

A Hioki voltammeter was used for measurement and four resistors with a resistance of 20 KΩ were connected in parallel to the output terminal of the solar panel 11 to measure a current and a voltage. In order to measure the photovoltaic power generated, the same solar panel 11 was used to receive direct rays from the clear sky at 2 p.m., Mar. 24, 2011 and the voltage and current of the solar panel 11 were measured.

In the case of power generation using the lamp, when the voltage was 42.7V and the current was 8.7 mA, the amount of power generated per hour was 371 mW. In contrast, in the case of photovoltaic power generation, when the voltage was 60V and the current was 12 mA, the amount of power generated per hour was 720 mW. In the case of power generation using a lamp, power generation conditions are constant throughout the year. However, in the case of photovoltaic power generation, it is assumed that the amount of power generated per hour is 360 mW since power generation is unavailable for at least half a year due to the cloudy and rainy weather.

In addition, in the case of power generation using the lamp, the power generation conditions are constant throughout 24 hours. However, in the case of photovoltaic power generation, the position of the sun varies over time and the incident angle of light on the solar panel 11 is changed. It is assumed that average power generation efficiency is about 70%. Therefore, the amount of power generated per hour is 252 mW.

Furthermore, in the case of power generation using the lamp, when the fluorescent lamp is turned on for 24 hours, it is possible to generate power for 24 hours and the amount of power generated per day is 8904 mW. However, in the case of photovoltaic power generation, the average annual daylight hours are 8 and the amount of power generated per day is 2016 mW.

As can be seen from the above, the power generation system using the lamp according to the Invention can have the greater power generation efficiency than the photovoltaic power generation system as long as it can ensure a sufficiently large area of the solar panel using a large number of fluorescent lamps or LED lamps.

Figure 6:
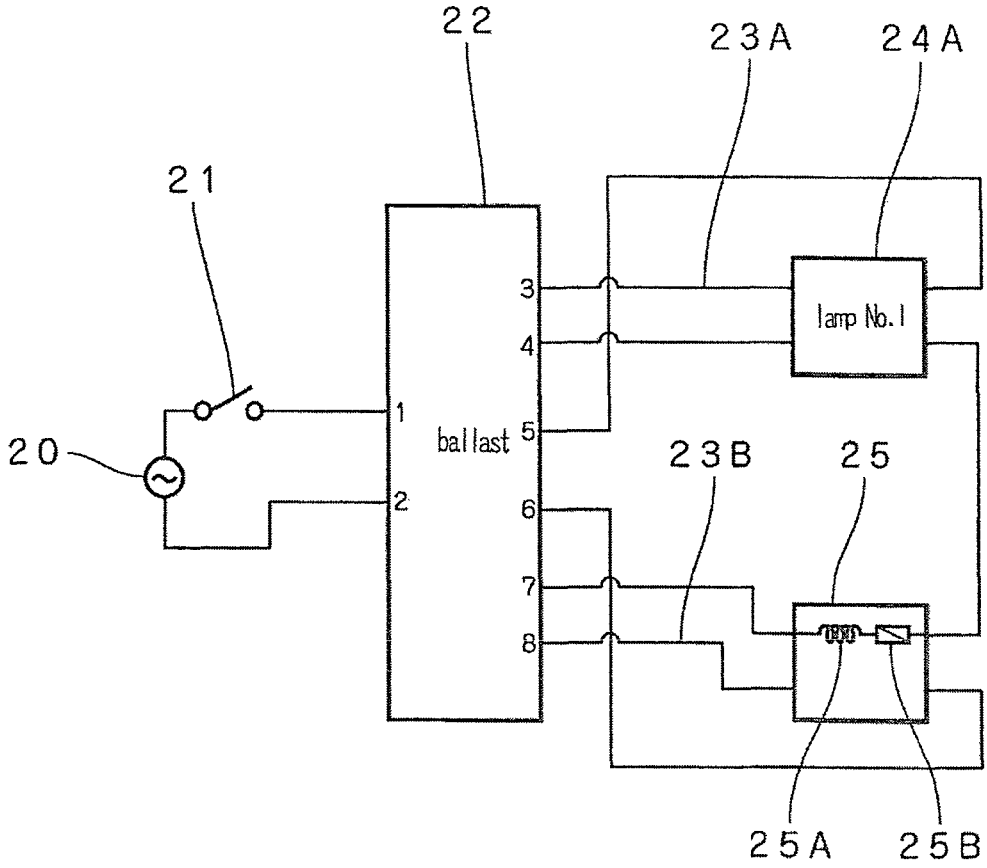
FIG. 6 is a schematic configuration diagram illustrating an example of a circuit of an exemplary embodiment of illuminating lamp equipment according to the invention.
Figure 7:
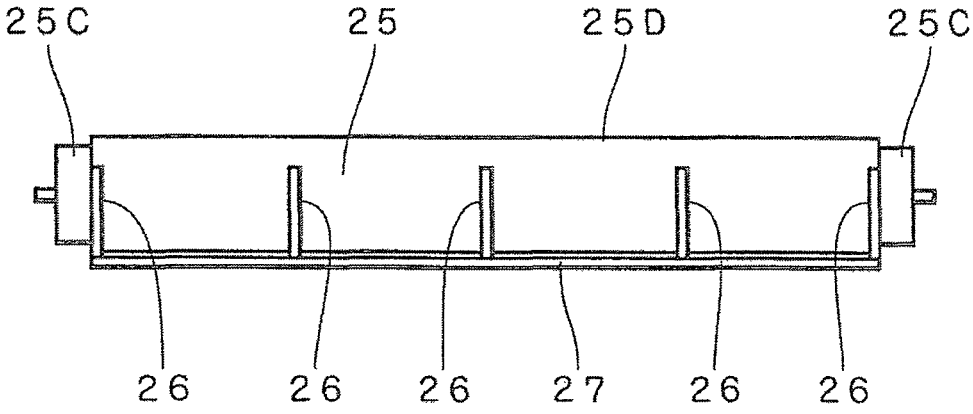
FIG. 7 is a cross-sectional view illustrating a fluorescent lamp dummy tube according to the embodiment.
Figure 8:
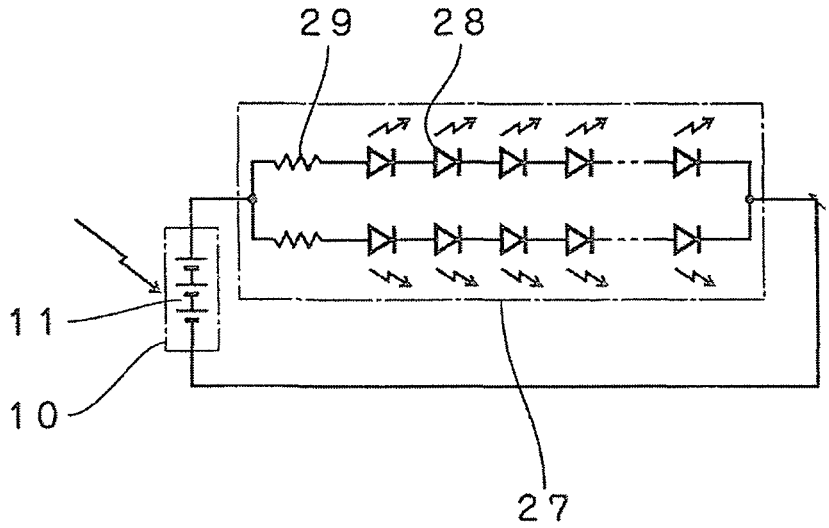
FIG. 8 is a circuit diagram illustrating an example of an LED circuit according to the embodiment.

FIGS. 6 to 8 show an exemplary embodiment of a illumination appliance according to the Invention. In FIGS. 6 to 8, the inverter-type ballast 22 is turned on and off by a power switch 21, receives an AC voltage of a commercial power supply 20, and outputs a predetermined high-frequency voltage.

Two current applying circuits 23A and 23B are connected in series to the output terminal of the inverter-type ballast 22 and are also connected in series to each other. A fluorescent lamp 24A and a fluorescent lamp dummy tube 25 are connected to the two current applying circuits 23A and 23B, respectively. A laminate of the transparent heat-resistant glass 12, the solar panel 11, and the aluminum foil 13 is attached to the rear surface of a lamp tube of the fluorescent lamp 24A to form a power generating lamp.

The fluorescent lamp dummy tube 25 has a structure in which caps 25C are fixed to both ends of a tube 25D made of heat-resistant plastic, a conductor connects the caps 25C, and an inductor 25A, which is a predetermined resistive component, and a fuse 25B are connected to the conductor.

An LED circuit 27 is attached to the lower surface of the fluorescent lamp dummy tube 25 by a plurality of C-shaped clips 26. As shown in FIG. 8, the LED circuit 27 has a structure in which two series circuits of a resistor 29 and a plurality of LEDs 28 are connected in parallel to each other. The LED circuit 27 is turned on by power generated by the fluorescent lamp 24A which serves as a power supply. In this way, the fluorescent lamp dummy tube 25 can be used for illumination.

Figure 9:
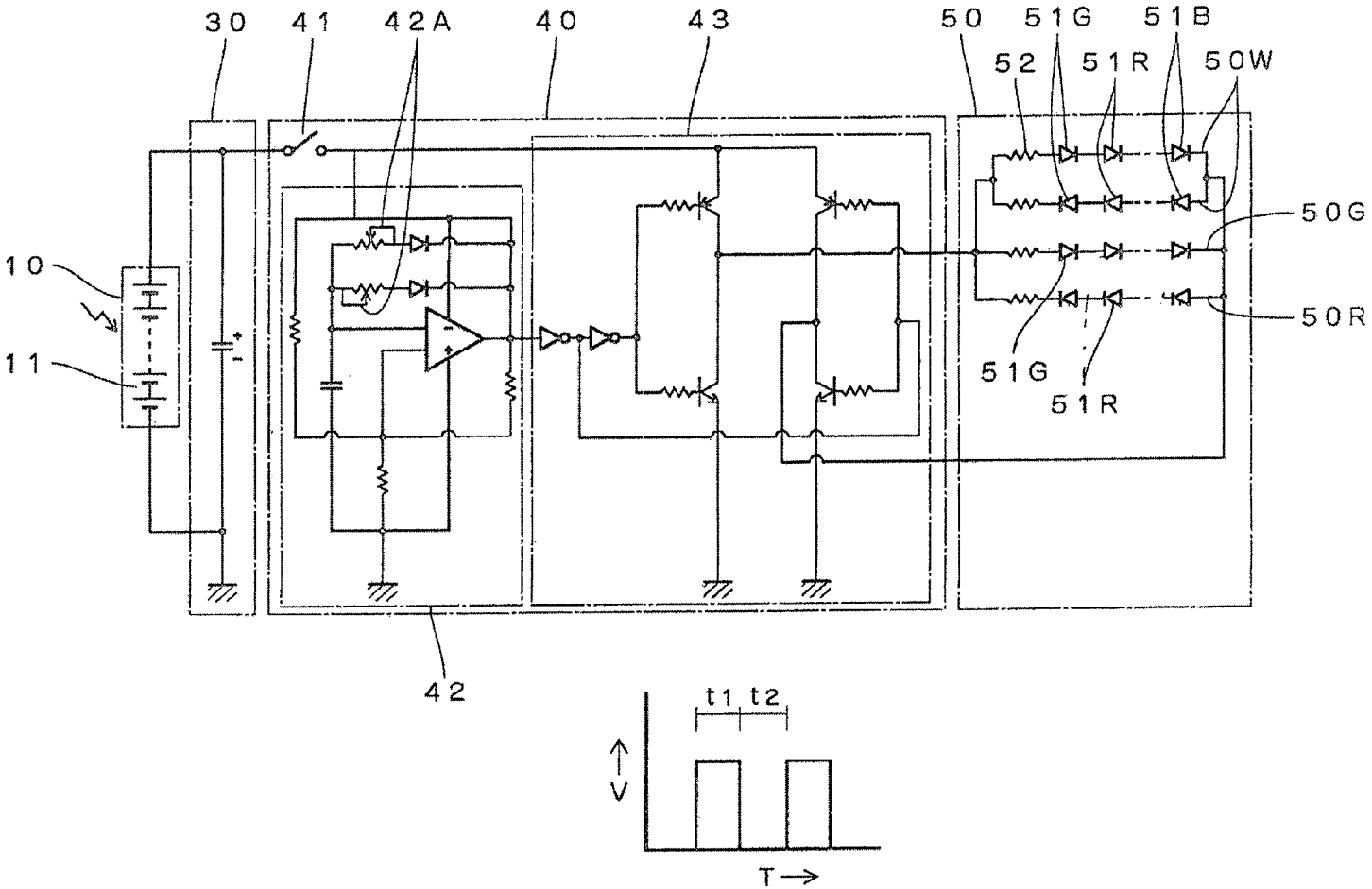
FIG. 9 is a diagram illustrating an example of the circuit structure of another LED circuit and another driver circuit according to the embodiment.

FIG. 9 shows a second embodiment of the illumination appliance according to the Invention. In this embodiment, the electromotive force of a power generating lamp 10 is charged to a capacitor of a charging circuit 30 and an output voltage from the capacitor is input to a controller 40 through a switch 41. The controller 40 includes a control signal generating circuit 42 that adjusts the resistance values of variable resistors 42A to adjust the duty ratio t1/t2 of a control signal and outputs the control signal and a driver circuit 43 that inverts the polarity of the control signal from the control signal generating circuit 42 in a predetermined cycle and outputs the inverted signal.

An LED circuit 50 is connected to an output terminal of the controller 40. The LED circuit 50 includes a pair of white LED circuits 50W which are connected in parallel to each other and first and second color calibration LED circuits 50G and 50R. Each of the pair of white LED circuits 50W includes blue, red, and green LEDs 51B, 51R, and 51G and a resistor 52 which are connected in series to each other. The pair of white LED circuits 50W are connected in parallel to each other such that they have opposite polarities and the blue, red, and green light components from the LEDs 51B, 51R, and 51G are added to emit a white light component.

The first color calibration circuit 50G includes a plurality of green LEDs 51G and a resistor 52 which are connected in series to each other. The second color calibration circuit 50R includes a plurality of red LEDs 51R and a resistor 52 which are connected in series to each other. The first color calibration circuit 50G and the second color calibration circuit 50R are connected in parallel to each other so as to have opposite polarities.

When the power generating lamp 10 receives light from the fluorescent lamp and generates power, the generated power is charged to the capacitor of the charging circuit 30. When the switch 41 is turned on, the higher of the voltage generated by the lamp and the discharge voltage of the charging circuit 30 is input to the control signal generating circuit 42 of the controller 40. The control signal generating circuit 42 outputs the control signal with the duty ratio t1/t2 determined by the resistance values of the variable resistors 42A and the driver circuit 43 inverts the polarity of the control signal in a predetermined cycle (a cycle capable of preventing the eye from perceiving a flicker) and outputs the inverted signal to the LED circuit 50.

In the LED circuit 50, the pair of white LED circuits 50W constantly emit a white light component, and the first and second color calibration circuits 50G and 50R alternately emit green and red light components. The green and red light components are alternately added to the white light component, which is a base color light component, to generate light with a color temperature determined by duty ratio t1/t2. Therefore, it is possible to freely control the color temperature by adjusting the resistance values of the variable resistors 42A in the control signal generating circuit 42.

Figure 10:
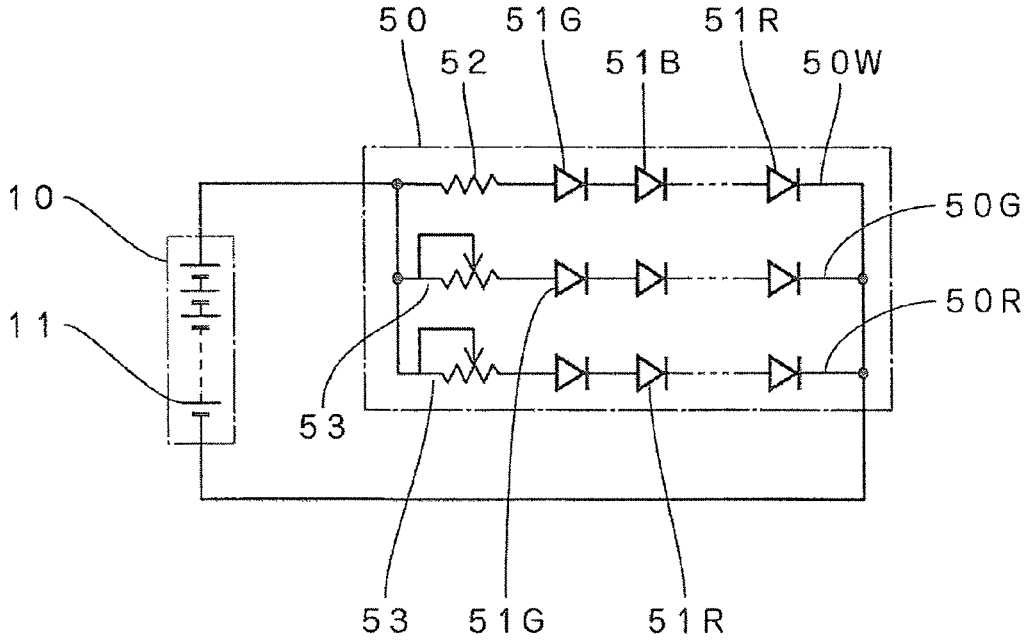
FIG. 10 is a circuit diagram illustrating another example of the LED circuit according to the embodiment.

In the above-described embodiment, the duty ratio given to the LED circuit is adjusted. As in a third embodiment of the illumination appliance according to the Invention shown in FIG. 10, the resistance values of resistors 53 in the first and second color calibration circuits 50G and 50R may be adjusted to adjust the amount of current flowing through the LEDs 51G and 51R of the first and second color calibration circuits 50G and 50R, thereby controlling the intensity of light emitted. The color temperature may be controlled by the addition of light color components.

Figure 11:
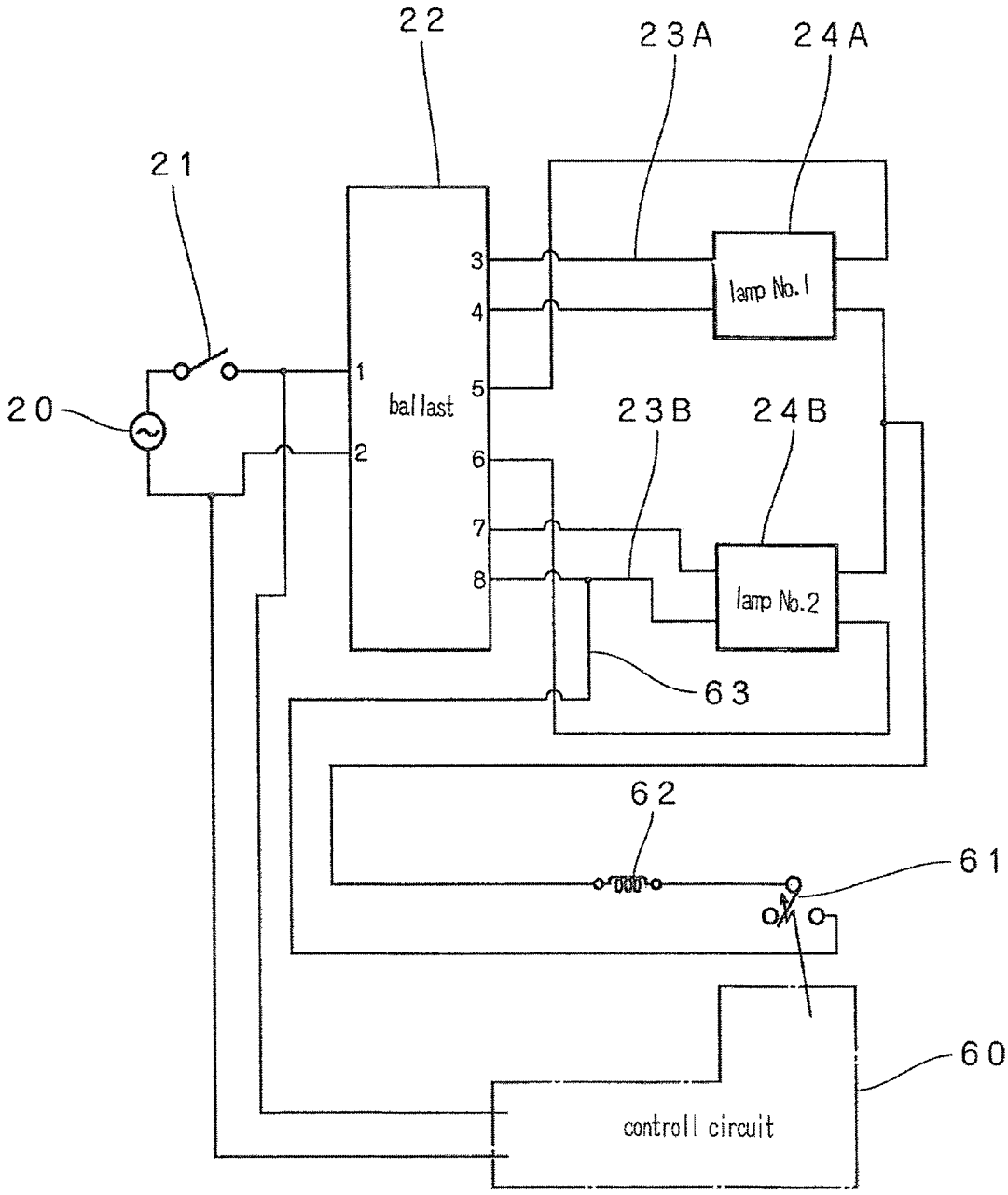
FIG. 11 is a schematic configuration diagram illustrating an example of a second embodiment of the illuminating lamp equipment according to the invention.
Figure 12:
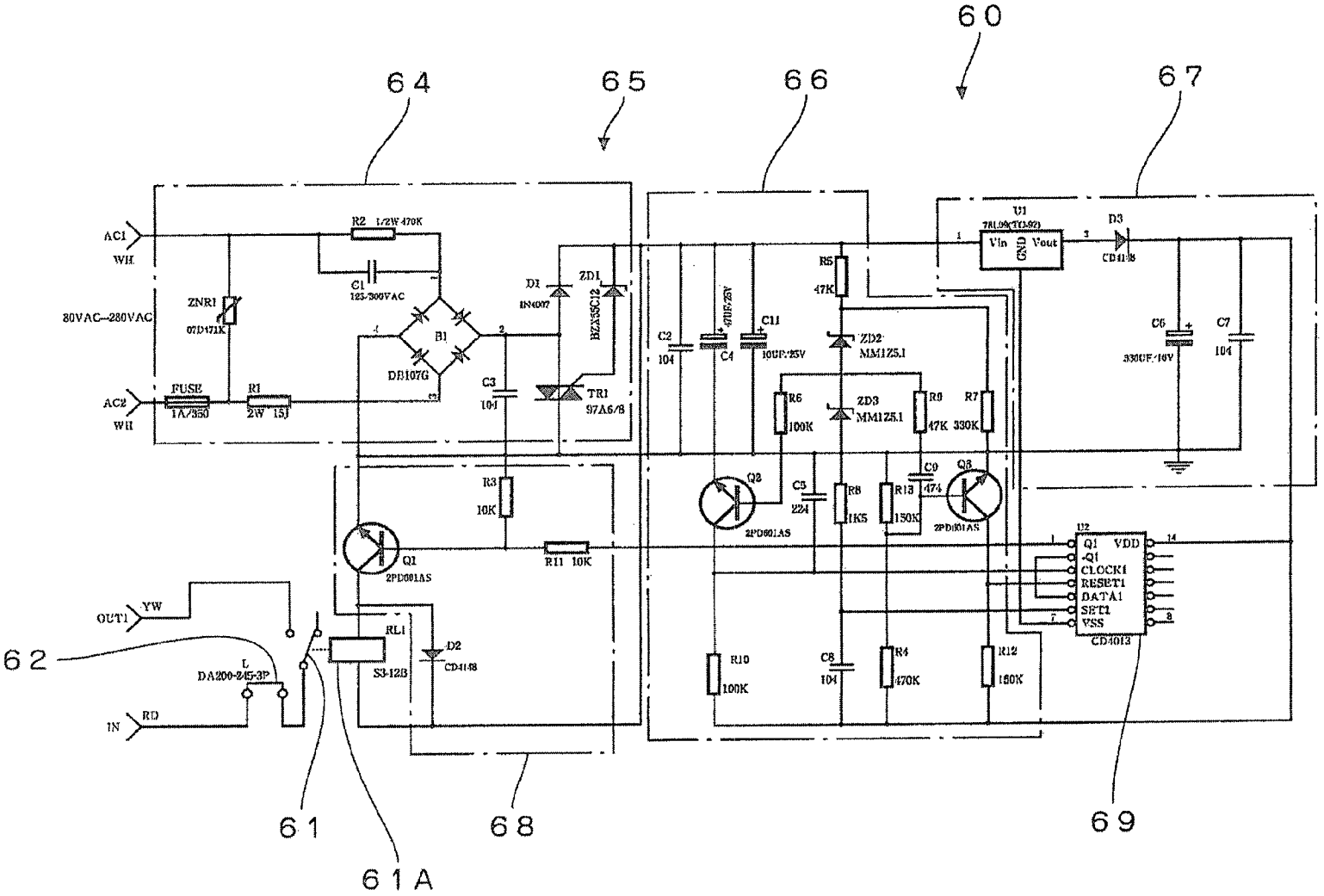
FIG. 12 is a diagram illustrating an example of the structure of a control circuit according to the embodiment.
Figures 13, 14:
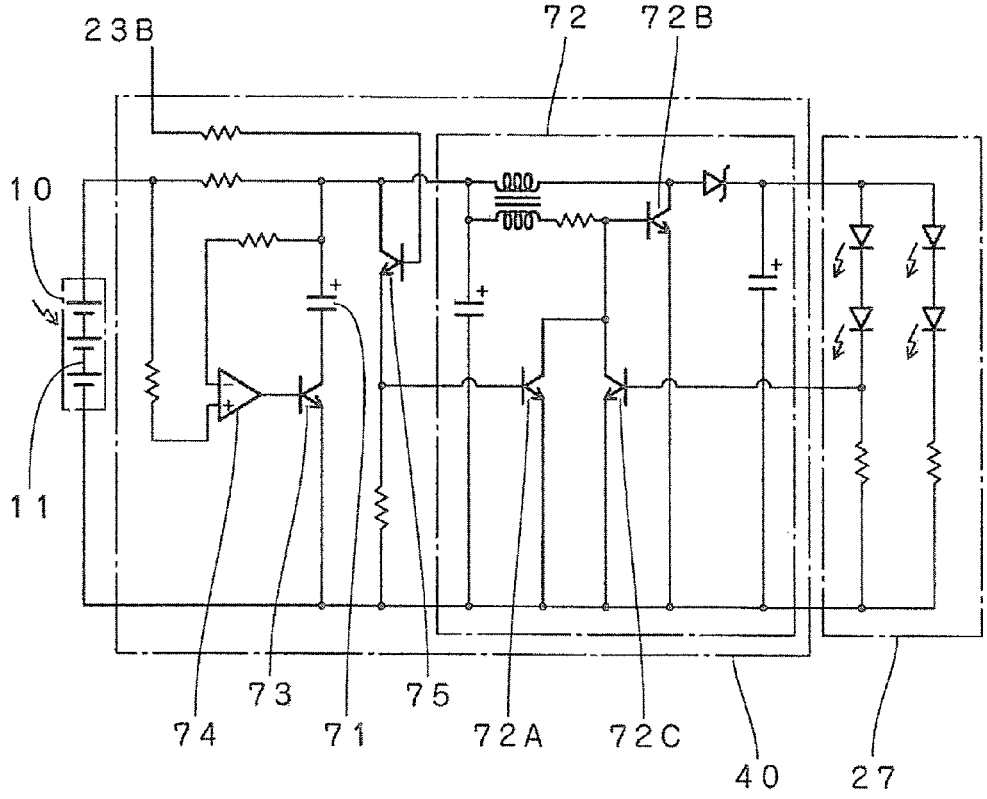
FIG. 13 is a diagram illustrating a truth table for the operation of a D-type flip-flop circuit of the circuit.
FIG. 14 is a diagram illustrating the circuit structure of illuminating lamp equipment according to another embodiment.

FIGS. 11 to 13 show a fourth embodiment of the illumination appliance according to the Invention. The inverter-type ballast 22 is turned on and off by a power switch 21, receives an AC voltage from a commercial power supply 20, and outputs a predetermined high-frequency voltage.

Two current applying circuits 23A and 23B are connected in series to the output terminal of the inverter-type ballast 22, and fluorescent lamps 24A and 24B are connected to the two current applying circuits 23A and 23B. A laminate of a transparent heat-resistant glass 12, a solar panel 11, and aluminum foil 13 is attached to the rear surface of a lamp tube of the fluorescent lamp 24A to form a power generating lamp. An LED circuit (not shown) is provided in the vicinity of the fluorescent lamp 24B which is turned off.

One end of a turn off circuit 63 is connected to a common circuit of the current applying circuits 23A and 23B. An inductor 62 and a relay contact 61 are connected in the middle of the off circuit 63. The other end of the off circuit 63 is connected to the current applying circuit 23B, and the relay contact 61 is turned on and off by a control circuit 60 which operates in response to the on and off states of the power switch 21.

The control circuit 60 has, for example, the circuit structure shown in FIG. 12. That is, specifically, the control circuit 60 may include a D-type flip-flop circuit (hereinafter, the flip-flop circuit is simply referred to as an FF circuit) 69. FIG. 13 shows a truth table for the operation of the D-type FF circuit 69.

The control circuit 60 includes a rectifying circuit 64, a clock generating circuit 66, a D-type FF circuit 69, a charging and discharging circuit 67 and a switching circuit 68. The rectifying circuit 64 receives an AC voltage from a commercial power supply 20 and rectifies the voltage, the clock generating circuit 66 generates a clock signal when power is turned on, the D-type FF circuit 69 inverts an output signal in response to the input of the clock signal. The charging and discharging circuit 67 receives and charges a circuit voltage and maintains the operation state of the D-type FF circuit 69 during discharge after the power switch 21 is turned off, and the switching circuit 68 supplies a current to a relay coil 61A according to the output signal from the D-type FF circuit 69, thereby turning on and off the relay contact 61.

In addition, a transistor TR1 is provided so as to be operated by an AC power supply voltage of 80 V to 280 V, thereby performing voltage control. In addition, for lightning protection, a Zener diode ZD1 is provided and a fuse FUSE is broken due to excess current.

First, when the power switch 21 is turned on, the voltage extracted from a connection point between Zener diodes ZD2 and ZD3 is dropped by a resistor R6 and is then applied to the base of a transistor Q2. The resistance value of a resistor R6 is set such that the base voltage of the transistor Q2 is an operation voltage.

When the power switch 21 is turned on first, the transistor Q2 is turned on and the clock signal from the collector of the transistor Q2 is given to a clock terminal CLOCK1 of the D-type FF circuit 20.

In this case, since an inverting terminal –Q1 of the D-type FF circuit 69 is at an "H" level and a data terminal DATA1 thereof is at an "H" level, an output terminal Q1 of the D-type FF circuit 69 is maintained at an "L" level until the signal from the clock terminal CLOCK1 falls.

When the output terminal Q1 of the D-type FF circuit 69 is maintained at the "L" level, the base voltage of the transistor Q1 is equal to or less than the operation voltage. The transistor Q1 does not operate, no current is supplied to the relay coil 61A, and the relay contact 61 is turned off. Therefore, both the fluorescent lamps 24A and 24B are turned on.

In the D-type FF circuit 69, the data of the data input DATA1 is read to the D-type FF circuit 69 at the falling edge of the clock signal and is output to the output terminal Q1 at the next rising edge of the clock signal.

An "H-level" signal is input to each of a set terminal SET1 and a reset terminal RESET1 of the D-type FF circuit 69 to set and reset the D-type FF circuit 69 independently from the input of the clock signal. The reset terminal RESET1 is connected to the collector of a transistor Q3.

When the circuit voltage is applied to the charging and discharging circuit 67, capacitors C6 and C7 are charged. After the application of the voltage is stopped, the capacitors C6 and C7 are discharged and the operation state of the D-type FF circuit 69 is maintained until the voltage is equal to or less than a predetermined value by the discharge. The discharge time is determined by the capacitors C6 and C7 and circuit resistance.

When the power switch 21 is turned on again during the discharge until the voltage of the capacitors C6 and C7 is reduced to a predetermined voltage, for example, for 0.2 to 2.5 seconds, the clock signal from the collector of the transistor Q2 is given to the clock terminal CLOCK1 of the D-type FF circuit 69, and the output terminal Q1 and the inverting terminal –Q1 of the D-type FF circuit 69 are maintained at "H" and "L" levels, respectively.

Then, at this time, the base voltage of the transistor Q1 is the operation voltage and the transistor Q1 operates. Then, a current is supplied to the relay coil 61A and the relay contact 61 is turned on. Therefore, the fluorescent lamp 24A is turned on. However, the turn off circuit 63 connects contact pins provided at both ends of the fluorescent lamp 24B with the resistive component determined by the inductor 62. Therefore, the fluorescent lamp 24B is not turned on.

After one lamp is turned off, the power switch 21 is turned off. Then, when the power switch 21 is turned on again during discharge until the capacitors C6 and C7 are reduced to a predetermined voltage, for example, for 0.2 to 2.5 seconds, the clock signal from the collector of the transistor Q2 is given to the clock terminal CLOCK1 of the D-type FF circuit 69. The output terminal Q1 of the D-type FF circuit 20 is maintained at an "L" level and the inverting terminal –Q1 thereof is maintained at an "H" level.

Then, at this time, the base voltage of the transistor Q1 is equal to or less than the operation voltage and the transistor Q1 does not operate. Therefore, no current is supplied to the relay coil 61A and the relay contact 61 is turned off. Both the fluorescent lamps 24A and 24B are turned on.

On the other hand, when the power switch 21 is turned off and the capacitors C6 and C7 are discharged to a predetermined voltage, the D-type FF circuit 69 is initialized and no current is supplied to the relay coil 61A. Therefore, the relay contact 61 returns to the off state such that both the fluorescent lamps 24A and 24B can be turned on.

As described above, when the power switch 21 is repeatedly turned on and off, the D-type FF circuit 69 is flip-flopped to control and hold the relay contact 61. Therefore, it is possible to control switching between an operation of turning on two lamps and an operation of turning one lamp.

Therefore, the LED circuit is set in the vicinity of the fluorescent lamp 24B to be turned off. When one lamp is turned off, the switch is operated to apply the voltage generated by the fluorescent lamp 24A or the voltage charged to, for example, the capacitor to the LED circuit. In this way, it is possible to use the LED circuit as a supplemental light of the fluorescent lamp 24B.

In the above-described embodiment, the controller 40 is configured such that the power switch 21 is operated to turn on the LED circuit 50 with the electromotive force of the solar panel 11. However, as shown in FIG. 14, the controller 40 may be configured so as to temporarily turn on the LED circuit 27 when the supply of power to the fluorescent lamp 24B is cut.

The controller 40 gives the electromotive force of the solar panel 11 to a supercapacitor (electric double-layer capacitor) 71 to charge the supercapacitor 71. The supercapacitor 71 gives the charged voltage to an oscillating circuit 72 and the oscillating circuit 72 turns on the LEDs of the LED circuit 27 only for the time which is determined by a discharge time constant of the supercapacitor 71.

A transistor 73 is connected between the supercapacitor 71 and the ground and the output of a comparison circuit 74 is connected to the base of the transistor 73. The comparison circuit 74 compares the charged voltage of the supercapacitor 71 and a reference voltage. When the charged voltage reaches the reference voltage, the comparison circuit 74 reduces the voltage of the base of the transistor 73 to turn off the transistor 73, thereby stopping the charging of the supercapacitor 71.

A transistor 75 and a resistor are connected to between the ground and a connection point between the supercapacitor 71 and the oscillating circuit 72. A connection point between the source of the transistor 75 and the resistor is connected to the base of a transistor 72A of the oscillating circuit 72. The base of the transistor 75 is connected to, for example, the current applying circuit 23B for the fluorescent lamp 24B shown in FIG. 11.

At that time, when the power switch 21 is turned on, an AC voltage of the commercial power supply 20 is applied to the inverter-type ballast 22 and is then converted into a predetermined high-frequency voltage. The predetermined high-frequency voltage is applied to the fluorescent lamps 24A and 24B and the fluorescent lamps 24A and 24B are turned on.

The solar panel 11 receives light emitted from the fluorescent lamp 24A and generates electromotive force. The electromotive force is given to the supercapacitor 71 and the supercapacitor 71 is charged.

When the charged voltage of the supercapacitor 71 reaches the reference voltage, the comparison circuit 74 outputs an "L" signal and the transistor 73 is turned off. Therefore, the charging of the supercapacitor 71 is stopped. In this way, overcharging is prevented.

In this case, the voltage which is dropped by the resistor is applied to the base of the transistor 75 such that the transistor 75 is turned on, and a transistor 73A is turned on. Therefore, the oscillating circuit 72 does not oscillate and the LEDs are not turned on.

When the supply of power to the fluorescent lamp 24B is stopped and the fluorescent lamp 24B is turned off, the transistor 75 is reduced to the base voltage and is turned off, and the transistor 72A is turned off. The transistor 72B and the transistor 72C are alternately turned on and off to oscillate the oscillating circuit 72, and the LEDs are turned on for the time which is determined by the discharge time constant of the super-capacitor 71.

Therefore, after the fluorescent lamp 24B is turned off, the LEDs are turned on for a limited period of time. Therefore, this structure can be used for emergency lights or guidance lights.

In addition, overcharging does not occur in the supercapacitor 71, the power-off of the lighting apparatus is detected, and the LEDs are turned on for a limited period of time. Therefore, an error does not occur in an operation of turning on the LEDs and operation reliability is high.

REFERENCE SIGNS LIST

10: POWER GENERATING LAMP
11: SOLAR PANEL
11A: ELECTRIC WIRE
12: TRANSPARENT HEAT-RESISTANT GLASS (TRANSPARENT HEAT-RESISTANT LAYER)
13: ALUMINUM FOIL (HEAT-DISSIPATING METAL FOIL)
14: LAMP TUBE
15: HOLDER FRAME
27, 50: LED CIRCUIT
40: CONTROLLER

The invention claimed is:

1. A power generating lamp comprising:

a linear or annular lamp tube that is supplied with power and emits light;

one or a plurality of solar panels that have an arc shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth of the length of the outer circumference of a cross-section of the lamp tube and equal to or less than half the length of the outer circumference, receive light emitted from a rear surface of the lamp tube, and generate electromotive force;

a transparent heat-resistant layer that is formed on a light receiving surface of the solar panel and is attached to the rear surface of the lamp tube or is arranged on the rear side of the lamp tube such that a distance between the light receiving surface and the rear surface of the lamp tube is equal to or less than 10 mm; and an electric wire that extracts the electromotive force of the solar panel.

2. The power generating lamp according to claim 1, wherein the lamp tube is a lamp tube of a fluorescent lamp which includes high-temperature regions provided at both ends thereof and a low-temperature region provided between the high-temperature regions or a lamp tube of an LED lamp whose entire surface is a low-temperature region.

3. The power generating lamp according to claim 1, wherein the solar panel has a length that is equal to the total length of the low-temperature region of the lamp tube in the longitudinal direction or the total length thereof in the circumferential direction, and the transparent heat-resistant layer is attached to the rear surface of the low-temperature region.

4. The power generating lamp according to claim 1, wherein a heat-dissipating metal foil is attached to the rear surface of the solar panel.

5. The power generating lamp according to claim 1, further comprising:

a holder frame that holds the solar panel and the transparent heat-resistant layer on the rear side of the lamp tube such that the distance between the light receiving surface of the solar panel and the rear surface of the lamp tube is equal to or less than 10 mm.

6. A power generating lamp comprising:

a linear or annular lamp tube that is supplied with power and emits light;

one or a plurality of solar panels that have a linear shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth of the length of the outer circumference of a cross-section of the lamp tube and equal to or less than half the length of the outer circumference, receive light emitted from a rear surface of the lamp tube, and generate electromotive force;

a transparent heat-resistant layer that is formed on a light receiving surface of the solar panel and is arranged on the rear side of the lamp tube such that a distance between the light receiving surface and the rear surface of the lamp tube is equal to or less than 10 mm; and an electric wire that extracts the electromotive force of the solar panel.

7. The power generating lamp according to claim 6, wherein the lamp tube is a lamp tube of a fluorescent lamp which includes high-temperature regions provided at both ends thereof and a low-temperature region provided between the high-temperature regions or a lamp tube of an LED lamp whose entire surface is a low-temperature region.

8. The power generating lamp according to claim 6, wherein a heat-dissipating metal foil is attached to the rear surface of the solar panel.

9. The power generating lamp according to claim 6, further comprising:

a holder frame that holds the solar panel and the transparent heat-resistant layer on the rear side of the lamp tube such that the distance between the light receiving surface of the solar panel and the rear surface of the lamp tube is equal to or less than 10 mm.

10. An illumination appliance comprising:

a power generating lamp including: a linear or annular lamp tube that is supplied with power and emits light; one or a plurality of solar panels that have an arc or linear shape in a cross-sectional view, have a length that is equal to or less than the total length of the lamp tube in a longitudinal direction or the total length thereof in a circumferential direction and is equal to or greater than the total length of a low-temperature region of the lamp tube in the longitudinal direction or the total length thereof in the circumferential direction and a width that is equal to or greater than one-fifth of the length of the outer circumference of a cross-section of the lamp tube and equal to or less than half the length of the outer circumference, receive light emitted from a rear surface of the lamp tube, and generate electromotive force; a transparent heat-resistant layer that is formed on a light receiving surface of the solar panel and is attached to the rear surface of the lamp tube or is arranged on the rear side of the lamp tube such that a distance between the light receiving surface and the rear surface of the lamp tube is equal to or less than 10 mm; and an electric wire that extracts the electromotive force of the solar panel; and an LED circuit that includes a plurality of LEDs, receives the electromotive force of the power generating lamp, and emits light.

11. The lighting apparatus according to claim 10, wherein the LED circuit is attached to a fluorescent lamp dummy tube in which a conductor, which is a predetermined resistive component, connects caps provided at both ends.

12. The illumination appliance according to claim 10, further comprising:

a charging circuit that is connected to the electric wire, charges the electromotive force of the solar panel to a rechargeable battery or a capacitor, and supplies the electromotive force to the LED circuit.

13. The illumination appliance according to claim 10, further comprising:

a driver circuit wherein the LED circuit includes:

a pair of white LED circuits each of which includes blue, red, and green LEDs connected in series to each other and which are connected in an opposite direction and emit white light;

a first color calibration LED circuit that is connected in parallel to the white LED circuits and emits green light; and a second color calibration LED circuit that is connected in parallel to the white LED circuits and the first color calibration LED circuit, is connected to the first color calibration LED circuit in the opposite direction, and emits red light, the driver circuit applies a voltage with an adjusted duty ratio to both ends of the white LED circuit while inverting the polarity of the voltage, and the duty ratio is controlled to adjust a color temperature.

14. The lighting apparatus according to claim 10, wherein the LED circuit includes:

a white LED circuit that emits white light;

a first color calibration LED circuit that can adjust an on current, is connected in parallel to the white LED circuit, and emits green light; and a second color calibration LED circuit that can adjust an on current, is connected in parallel to the white LED circuit and the first color calibration LED circuit, and emits red light, and the on currents of the first color calibration LED circuit and the second color calibration LED circuit are controlled to adjust a color temperature.

15. The lighting apparatus according to claim 10, wherein, in a two-lamp-series-type illuminating lamp equipment in which both ends of one illuminating lamp of two illuminating lamps are connected to each other by an off circuit, which is a predetermined resistive component, and the off circuit is turned off by a flip-flop operation of a control circuit to turn off the illuminating lamp when a power switch is changed from an on state to an off state and is turned on again within a predetermined period of time, a laminate of the transparent heat-resistant layer, the solar panel, and the aluminum foil is provided on a rear surface of the other illuminating lamp to form the power generating lamp, and the LED circuit is provided in the vicinity of the illuminating lamp which is turned off.

* * * * *